United States Patent [19]

Spehar

[11] Patent Number: 5,003,696

[45] Date of Patent: Apr. 2, 1991

[54] UTILITY KNIFE WITH OPPOSING BLADES

[76] Inventor: Eli G. Spehar, 19441 Perch Cir., Huntington Beach, Calif. 92646

[21] Appl. No.: 375,866

[22] Filed: Jul. 5, 1989

[51] Int. Cl.[5] ..... B26B 3/00

[52] U.S. Cl. ..... 30/299; 30/294; 30/286

[58] Field of Search ..... 30/299, 294, 293, 287, 30/290, 162

[56] References Cited

U.S. PATENT DOCUMENTS

| | | | |
|---|---|---|---|
| 2,681,506 | 6/1954 | Tipple | 30/299 |
| 4,227,306 | 10/1980 | Meshulam | 30/342 |
| 4,805,304 | 2/1989 | Knoop | 30/162 |

*Primary Examiner*—Hien H. Phan
*Assistant Examiner*—Willmon Fridie, Jr.

[57] ABSTRACT

A utility knife consisting of a flat blade holder is capable of being grasped from above. It contains opposing cutting blades mounted in slots in the holder such that each blade is clamped in place and may be laterally adjusted using a leverage system formed by several cuts in the holder itself. The holder has two guide surfaces joined at an obtuse angle so that when one is in contact with the material for cutting the other is elevated above it and vice versa. In use the first guide surface and blade is placed against the material for cutting and the holder is drawn in a first direction thereby cutting the material with the rearward facing blade until reaching a corner, whereby the forward raised blade abuts the corner. The forward guide edge and blade is lowered into contact with the material for cutting thereby raising the rearward blade and the holder is now drawn in the reverse direction thereby completing the cut without the need to turn the knife around or lift it from the cutting surface.

4 Claims, 2 Drawing Sheets

UTILITY KNIFE WITH OPPOSING BLADES

FIELD OF THE INVENTION

My present invention relates to a utility knife and more particularly to a dual bladed knife for manual cutting of plastic or paper sheets and which is especially useful for trimming in corners.

BACKGROUND OF THE INVENTION

Various types of utility knives are known including U.S. Pat. No. 4,227,306 Meshulam which mounts two different kinds of blades and has a safety feature which prevents mounting blades at opposite ends at the same time. U.S. Pat. No. 4,602,433 to Whiting shows a wallpaper knife having a shape which controls the angle between blade and material to be cut. U.S. Pat. No. 4,805,304 to Knoop describes an improved knife having safety and use features which can be used by left or right handed persons.

None of the prior art disclosures show the combination of features and capabilities of the instant invention. It is the applicants opinion that the unique combination of elements used in the present invention contribute to an improved device which is both quite unique and extermely useful.

SUMMARY OF THE INVENTION AND OBJECTS

The within invention consists of a utility knife which may, for example, be used for trimming thin plastic films such as are used for tinting windows. The knife has a unique pentagonal shape fabricated out of a thin plate of plastic or other material. Two edges along the bottom of the knife form straight guide edges joined at an interior angle less then 180 degrees. Opposing blades are held by the knife with their cutting points protruding from the left and right sides of the knife where these sides join the two guide edges. In use one or the other of these two guide edges is placed against the surface to be cut thereby controlling the blade contact angle and penetration. The cutting blades protrude from the knife by only approximately ⅛ inches thereby preventing serious accidental cuts. Due to the low angle of attack of the cutting blades, blade life is significantly longer than with standard cutting tools. With one guide surface and blade in contact with the material for cutting, the other guide surface and blade is raised above the cutting surface. The leading, raised guide edge acts to form a pushing surface against the material for cutting, thereby forcing it into place ahead of the oncoming cutting blade. This helps to assure smooth and accurate cutting. The knife can be reversed for cutting in the opposite direction by rocking the knife over until the second guide surface and blade contacts the material to be cut while simultaneously raising the first guide surface and blade. In this manner the knife can be used to cut into blind corners without turning the knife around. Since the knife is constructed from a thin plate with the dimension between cutting blade and plate surface being small, a controlled cutting margin can be held during cuts by holding one face of the knife against a straight edge.

It is the primary object of the instant invention to provide an improved utility knife having a new and unique blade support and adjustment structure and configuration allowing a cutting method which overcomes the drawbacks found in prior art devices.

A major object of the disclosed invention is to provide a utility knife that allows cutting on a surface into a corner without removing the knife to reverse the cutting direction.

Another important object of the invention is to provide a knife that allows quick and easy adjustment of the cutting blades as well as safe storage.

A further object of the invention is to provide a knife that stores a large number of separate cutting blades.

A yet still further object of the invention is to provide a knife with a built-in squeegee useful for extracting waste or paste from under the material to be cut while flattening the cut material in preparation for trimming.

A final objective of the invention is to provide a knife that is extremely inexpensive to manufacture by virtue of being fabricated from a single piece of plastic material and having no assembly except to insert the blades.

These, together with the various ancillary objects and features of the instant invention which will become apparent as the following description proceeds, are attained by this unique utility knife as disclosed herein, the preferred embodiment thereof being shown in the accompanying drawings, by way of example only.

DRAWING REFERENCE NUMERALS

5—Utility Knife With Opposing Blades
10—Flat Plate
14—Front Planar Face
16—Rear Planar Face
20—Cutting Blade
30—Left Guide Edge
32—Right Guide Edge
40—Left Side Edge
42—Right Side Edge
50—Top Edge
52—Dull Point
60—Left Blade Holder Means
62—Right Blade Holder Means
70—Slot
80 —Lower Side
90 —Upper Side
100—Backwall
110—Linear Through Hole Cutout
120—Cutout Relief
130—Edge Notch
140—Lever
150—Material For Cutting
160—Side Wall

DESCRIPTION OF THE PREFERRED EMBODIMENT

Figure 1:
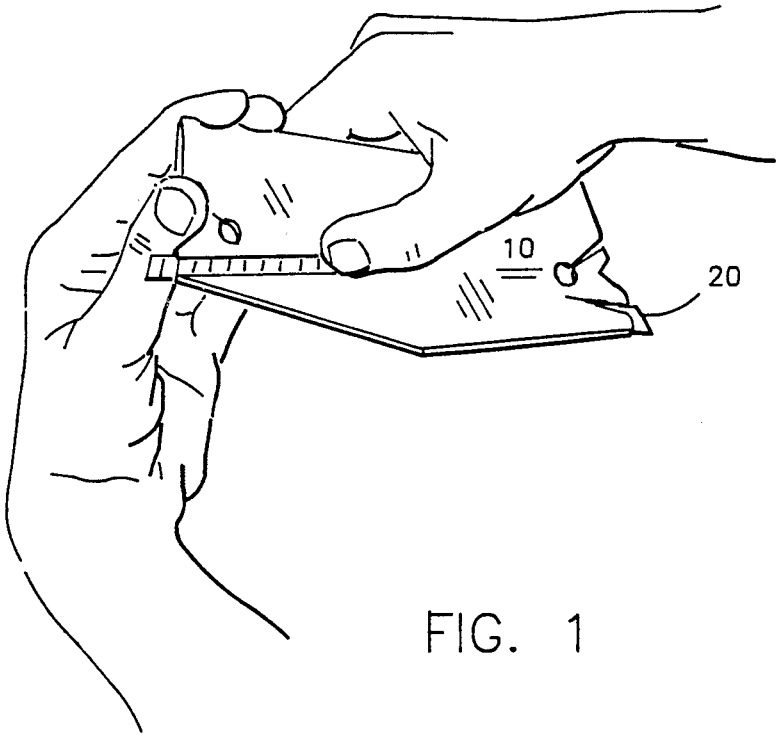
FIG. 1 is a perspective drawing of the invention showing the means for inserting and adjusting the cutting blades.
Figures 2, 3:
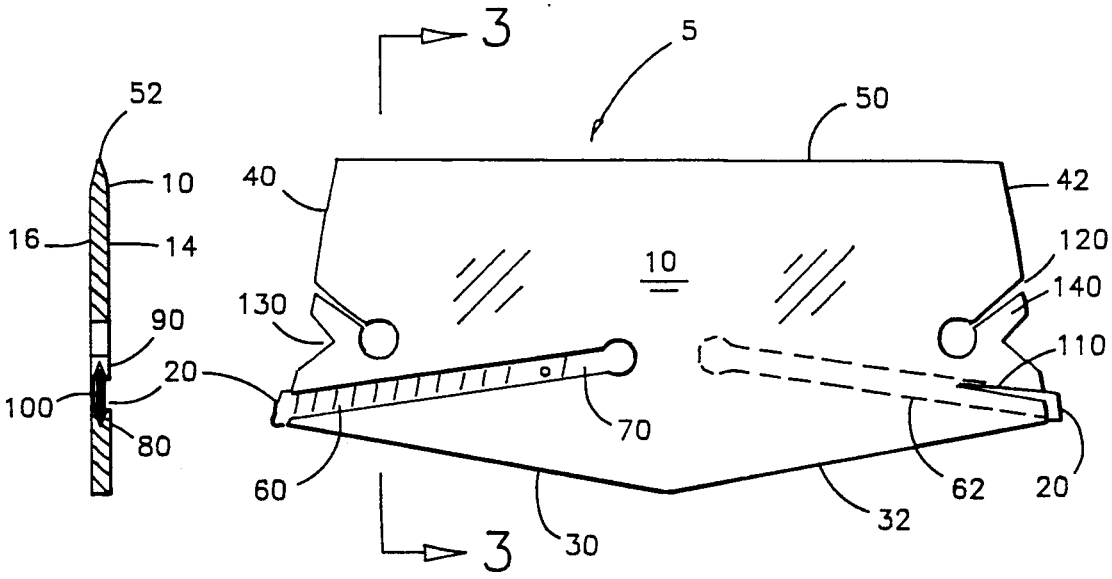
FIG. 2 is a front view of the invention.
FIG. 3 is a side view of the invention.

As shown in FIG. 1 a flat plate 10 is used to hold two opposing cutting blades 20. FIGS. 2 and 3 show details of the invention which is a utility knife with opposing blades 5. Flat plate 10 has a left blade holder means 60 and a right blade holder means 62 machined into front planar face 14 and rear planar face 16 respectively. Alternately, both blade holder means 60 and 62 can be cut into one face. Each blade holder means, 60 and 62 has an upper side 90 and a lower side 80 connected by a backwall 100 which forms a slot 70 in flat plate 10. Slot 70 has a linear through hole cutout 110 which extends from edges 40, 42 along upper side 90 for a length roughly equal to that of cutout relief 120. Slot 70 is slightly wider than blade 20 except along linear through hole cutout 110 where slot 70 is slightly narrower than blade 20. Slots 70 form an acute angle with guide edges 30, 32.

A left 30 and right guide edges, joined at an obtuse angle, form the lower edge of flat plate 10 while left 40 and right 42 side edges and top edge 50 complete the pentagonal shape of flat plate 10. Left 40 and right 42 side edges each have a cutout relief 120 and an edge notch 130 which together form a lever 140.

OPERATION OF THE INVENTION

As shown in FIG. 1, cutting blade 20 is manually mounted into slot 70 by applying pressure against lever 140 in the direction of cutout relief 120 and therefore causing linear through hole cutout 110 to widen. This allows slot 70 to pass blade 20 which is pushed up into slot 70. Since slot 70 is slightly narrower than blade 20 along linear through hole 110, blade 20 is clamped into place when pressure is released from lever 140. Blade 20 consists of a series of blade segments each one which can be snapped off in turn as it becomes dull through use. Each new end segment is then adjusted to protrude beyone side edges 40, 42 so that with guide edges 30 or 32 in contact with material for cutting 150, blades 20 are in an advantageous position to cut.

Figure 4:
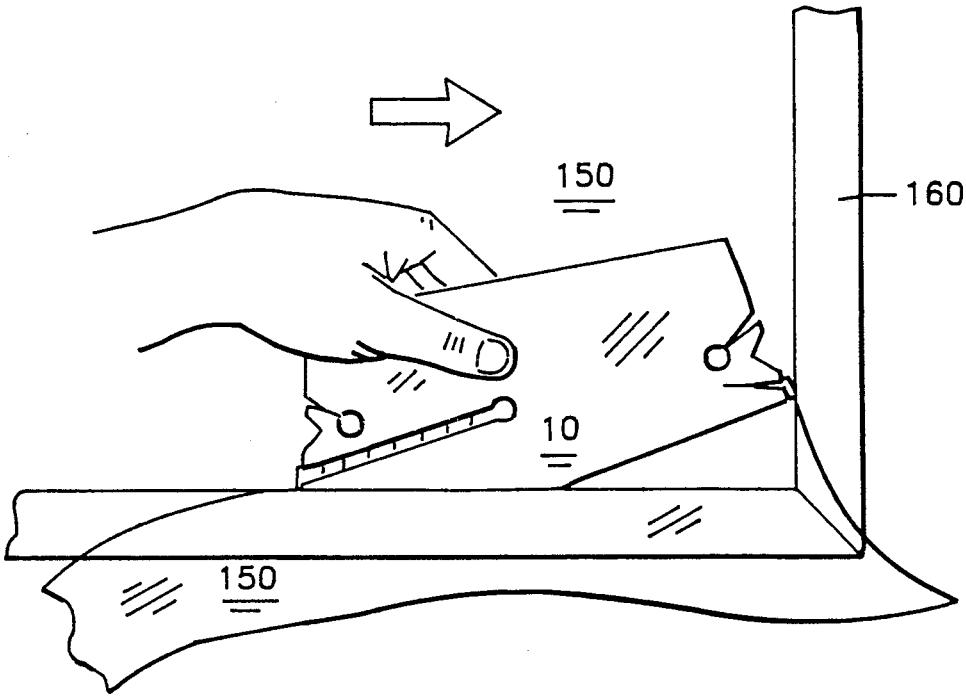
FIG. 4 is a front view showing the method of cutting into a corner.
Figure 5:
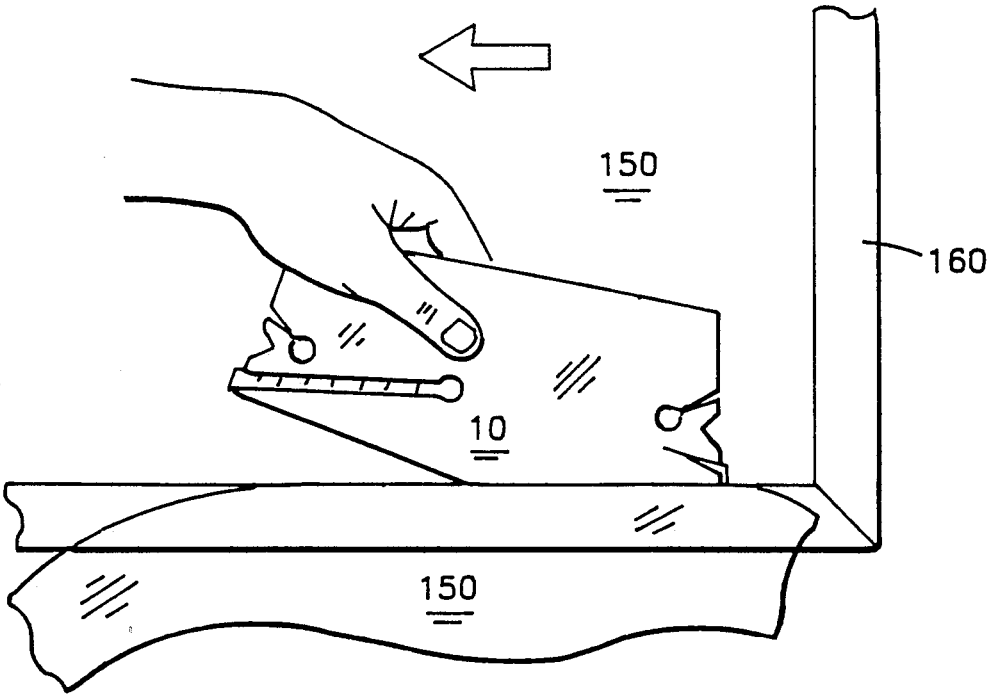
FIG. 5 is a front view showing the method of reversing to finish a corner cut.

FIGS. 4 and 5 show the method of using utility knife with opposing blades 5 for cutting into a corner. FIG. 4 shows knife 5 cutting from left to right using trailing blade 20 to trim material for cutting 150 into a corner on side wall 160. After reaching side wll 160 with leading blade 20 the cut is unfinished. FIG. 5 shows that to finish the cut leading blade 20 is lowered against material for cutting 150 and the direction of knife motion is reversed.

What is claimed is:

1. A utility knife comprising a pair of cutting blades and a flat plate, said flat plate comprising a front and rear planar faces having left and right guide edges, left and right sides, left and right blade holder means and a top edge, said left and right blade holder means each having an upper and a lower side for supporting therebetween, in compression, one said cutting blade, said left and right side edges, each containing a lever for adjustment of said compression force, said left and right guide edges, together forming the lower extremity of said flat plate, joined at an interior angle of approximately 160 degrees; whereby said blades protrude from said left and right side edges, in opposition, for cutting a material for cutting while moving said left or, alternately, said right guide surface against said material for cutting.

2. The utility knife according to claim 1 wherein said lever comprises a cutout relief and a notch in said left and right side edges.

3. The utility knife according to claim 1 or claim 2 wherein said left and right blade holder means further comprises a linear through hole cutout whereby said blade is more easily inserted and clamped within said blade holder means.

4. The utility knife according to claim 1 through claim 3 wherein said top edge is formed into a taper having a dull point whereby said top edge is useful as a scraper or a squeegee.

* * * * *